US008212765B2

(12) United States Patent
Kron et al.

(10) Patent No.: US 8,212,765 B2
(45) Date of Patent: Jul. 3, 2012

(54) PULSE WIDTH MODULATED DIMMING OF MULTIPLE LAMP LCD BACKLIGHT USING DISTRIBUTED MICROCONTROLLERS

(75) Inventors: Jonathan Kron, Beechhurst, NY (US); Bruce Roberts, Mentor on the Lake, OH (US); Laszlo S. Ilyes, Richmond Heights, OH (US)

(73) Assignee: General Electric Company, Schenectady, NY (US)

( * ) Notice: Subject to any disclaimer, the term of this patent is extended or adjusted under 35 U.S.C. 154(b) by 897 days.

(21) Appl. No.: 11/952,196

(22) Filed: Dec. 7, 2007

(65) Prior Publication Data

US 2009/0147176 A1 Jun. 11, 2009

(51) Int. Cl.
*G09G 3/36* (2006.01)

(52) U.S. Cl. ..... 345/102; 349/61

(58) Field of Classification Search ..... 345/690–691, 345/87–102; 349/61–62; 315/160–176
See application file for complete search history.

(56) References Cited

U.S. PATENT DOCUMENTS

| | | | | |
|---|---|---|---|---|
| 7,081,717 | B2 * | 7/2006 | Suzuki | 315/213 |
| 7,742,031 | B2 * | 6/2010 | Numao | 345/102 |
| 2005/0179404 | A1 * | 8/2005 | Veskovic et al. | 315/291 |
| 2006/0125426 | A1 * | 6/2006 | Veskovic et al. | 315/312 |
| 2006/0279516 | A1 * | 12/2006 | Yun | 345/102 |
| 2007/0176883 | A1 * | 8/2007 | Hsu et al. | 345/102 |
| 2008/0088574 | A1 * | 4/2008 | Tsujii | 345/102 |
| 2008/0136352 | A1 * | 6/2008 | Paeng et al. | 315/294 |

FOREIGN PATENT DOCUMENTS

WO WO 2004/084170 A1 9/2004

* cited by examiner

*Primary Examiner* — Amare Mengistu
*Assistant Examiner* — Hong Zhou
(74) *Attorney, Agent, or Firm* — Fay Sharpe LLP

(57) ABSTRACT

In a scanning backlight for an LCD display, several backlights ($\mathbf{10}_1$, $\mathbf{10}_2$, $\mathbf{10}_3$, $\mathbf{10}_n$) provide a precisely positioned dimming pulse corresponding to a transition point of the LCD screen. The dimming pulse must be variable with video synchronization frequency and dimming duty cycle, which is a performance intensive calculation. One microcontroller performing this operation is limited in scope. By using several ballast controllers ($\mathbf{14}_1$, $\mathbf{14}_2$, $\mathbf{14}_3$, $\mathbf{14}_n$), the solution is scalable, in that it is flexible if the number of backlights ($\mathbf{10}_1$, $\mathbf{10}_2$, $\mathbf{10}_3$, $\mathbf{10}_n$) changes. Additionally, by using several controllers ($\mathbf{14}_1$, $\mathbf{14}_2$, $\mathbf{14}_3$, $\mathbf{14}_n$), added functions can be performed by the ballast controllers ($\mathbf{14}_1$, $\mathbf{14}_2$, $\mathbf{14}_3$, $\mathbf{14}_n$).

24 Claims, 4 Drawing Sheets

PULSE WIDTH MODULATED DIMMING OF MULTIPLE LAMP LCD BACKLIGHT USING DISTRIBUTED MICROCONTROLLERS

BACKGROUND OF THE INVENTION

The present application relates to backlighting in liquid crystal displays (LCDs). More specifically, it relates to techniques of synchronizing the operation of multiple, independent, light-producing elements to enhance the apparent quality of moving images displayed on the LCD video display and will be described with particular reference thereto. It is to be appreciated that the present application is also applicable to other systems that utilize backlights, and is not limited to the above-referenced application.

Generally, in an LCD monitor, pixel intensity is controlled by controlling the amount of light that is let through the surface of the display. The liquid crystal elements are controlled by applying current to them, thereby creating dark pixels, or light pixels, or intermediate shades. The liquid crystal elements do not typically produce any light of their own, rather the visible portion comes from an array of backlights, and the liquid crystal elements selectively let that backlighting show, producing a visible image. Typically, these backlights have been cold cathode fluorescent lamps.

A moving image is produced on an LCD video display by sequentially updating the picture elements (pixels) at a rate that is somewhat faster than human perception. This rate, referred to as the scan rate of the video, is generally either 50 Hz or 60 Hz, depending on geographical region. It is generally known that the apparent sharpness of the moving image can be significantly improved by illuminating the pixels with the backlight only when the pixels have assumed a stable, unchanging state. As a consequence, the backlighting to the pixel must be extinguished during the finite time required to update the pixel to produce the next subsequent image in the video frame.

This technique had been demonstrated in commercially available LCD video displays using fluorescent tubes to backlight the LCD screen. Each lamp is systematically extinguished while the rows of pixels that it illuminates are updated. When the pixels in those rows have transitioned to form a stable image, the fluorescent tube is re-illuminated to reveal the LCD image to the observer. Each fluorescent lamp performs this action while each horizontal band across the video monitor is refreshed to display the next frame in the video. Since this action occurs according to the scan rate, the extinguishing and subsequent re-illumination of the fluorescent lamp is beyond the limits of human perception, producing a moving video image with apparently constant light intensity that is proportional to the time interval over which each fluorescent tube is illuminated. It can be appreciated that the average brightness of the observed image can be modulated up or down by modulating the on-off duty cycle of the fluorescent lamp.

To date, scanning has been accomplished in LCDs. Current systems handle synchronization and dimming control on the scanning backlight with a single large pin-out microcontroller, as shown in FIG. 1. This one microcontroller contains the scanning and dimming algorithm for all of the backlights, of which 12 lamps is a typical number. Typically, there is one inverter ballast for every lamp, that is, every lamp is being driven by its own power electronics circuit. To dim the lamp, a pulse width modulated (PWM) signal is used. When the PWM is off, it turns the lamp off. When the PWM is on, it turns the lamp on. To control dimming, a PWM signal of a length corresponding to dimming (i.e. the desired brightness of the lamp) is fed to each inverter corresponding to each lamp. Each lamp is offset by a certain amount, so that when the display scans down, it follows the visible pattern of the video image panning over the screen.

Several problems arise when using a single microprocessor to control the scanning of several backlights. First, at least one pin for each inverter (lamp) is required. The software involved to control such a system is relatively complex, and typically the actual processor is larger with more memory. The actual physical profile of the processor is also quite large, typically having a 64 pin configuration. Another drawback is that a single processor of this size is completely dedicated to the scanning control. It typically does not house enough processing capability to perform additional functions, such as end of life calculations, preheating and dimming of the lamps, and other lamp maintenance functions that are desirable in general, but not necessarily related to scanning.

Scanning PWM pulses can improve motion blur on LCD television screens. The main problem is how to handle the scanning requirement in a cost effective, power efficient and space efficient manner. An algorithm to run scannable dimming on twelve lamps is complex and computationally intensive. On top of this, there should be other functionality embodied in these processors to save cost and components.

Another problem is power consumption. Generally, the more tasks a single processor performs, the more power it draws, but inordinately more than the added functionality provided. Another problem lies in arrangement of the circuit. Physical layout of a circuit implementing a single processor controlled scanning system can be quite complex and cumbersome. Moreover, potential for failure is increased in a single processor system.

As the number of independent light producing elements increases, the computational intensity of synchronizing the light sources also increases. Since the scan rate is fixed, the amount of time during which calculations must be performed is likewise fixed. This places a significant demand on the capability of the microcontroller, particularly in large applications that require the use of many lamps. As the size of the display is scaled up, the capability and expense of the microcontroller increases. The display could even be scaled up to a point where the calculations required are beyond the capability of commercially available microcontrollers.

BRIEF DESCRIPTION OF THE INVENTION

In accordance with one aspect, a liquid crystal display is provided. The LCD includes a display face, and a plurality of backlights for illuminating the display face. The backlights produce a visible light on the display face. Each backlight is associated with an inverter ballast for providing power to the backlight. A plurality of liquid crystal elements selectively obscure light from the plurality of backlights when activated by application of current. A plurality of ballast controllers direct the ballasts to selectively dim the backlights during transition periods of the liquid crystal elements.

In accordance with another aspect, a method of compensating for response times of liquid crystal elements in a liquid crystal display is provided. A liquid crystal display screen is backlit with a plurality of backlights. At least a portion of the backlighting is selectively obscured by causing selected liquid crystal elements to become substantially opaque. With a plurality of microcontrollers, the plurality of backlights is selectively dimmed during transition periods of the liquid crystal elements.

In accordance with another aspect, a scanning control circuit is provided. A plurality of lamp ballasts provide power to lamps. A plurality of ballast controllers direct the lamp ballasts when to provide power to their respective lamps. A brightness controller directs the ballast controllers to selectively illuminate their associated lamps. A synchronization controller directs the ballast controllers to dim their respective lamps based on response times of display obscuring elements.

DETAILED DESCRIPTION OF THE INVENTION

The present application represents a scalable solution to providing a scanning backlight control. In a scanning backlight, every lamp controller typically provides a precisely positioned dimming pulse corresponding to the transition point of the LCD screen. This PWM pulse is typically variable with video synchronization frequency and dimming duty cycle, which is a performance intensive calculation. Also, the number of lamps the system can handle is dependent on the number of output pins on the microcontroller. By using multiple microcontrollers, the solution is scalable, in that if the number of lamps in the system were to increase or decrease, another microcontroller with the same code can be added to or removed from the system. Also, this provides a better cost optimization by allowing better matched microcontrollers for this application. There is also processing time left over for added functionality.

One feature of the present application includes having a video synchronization pulse relayed from one ballast controller to the next ballast controller, offset by the synchronization offset multiplied by the number of lamps. This allows the circuit to use distributed processing to calculate each lamp's dimming position and the pulse width, while allowing for added features and the ability to use a lower cost per lamp ballast controller. Also, the circuit is not limited to a particular number of lamps, in that additional microcontrollers with the same software (with certain constants changed to correspond to the lamp number) can be added based on changing scalability requirements.

Figure 1:
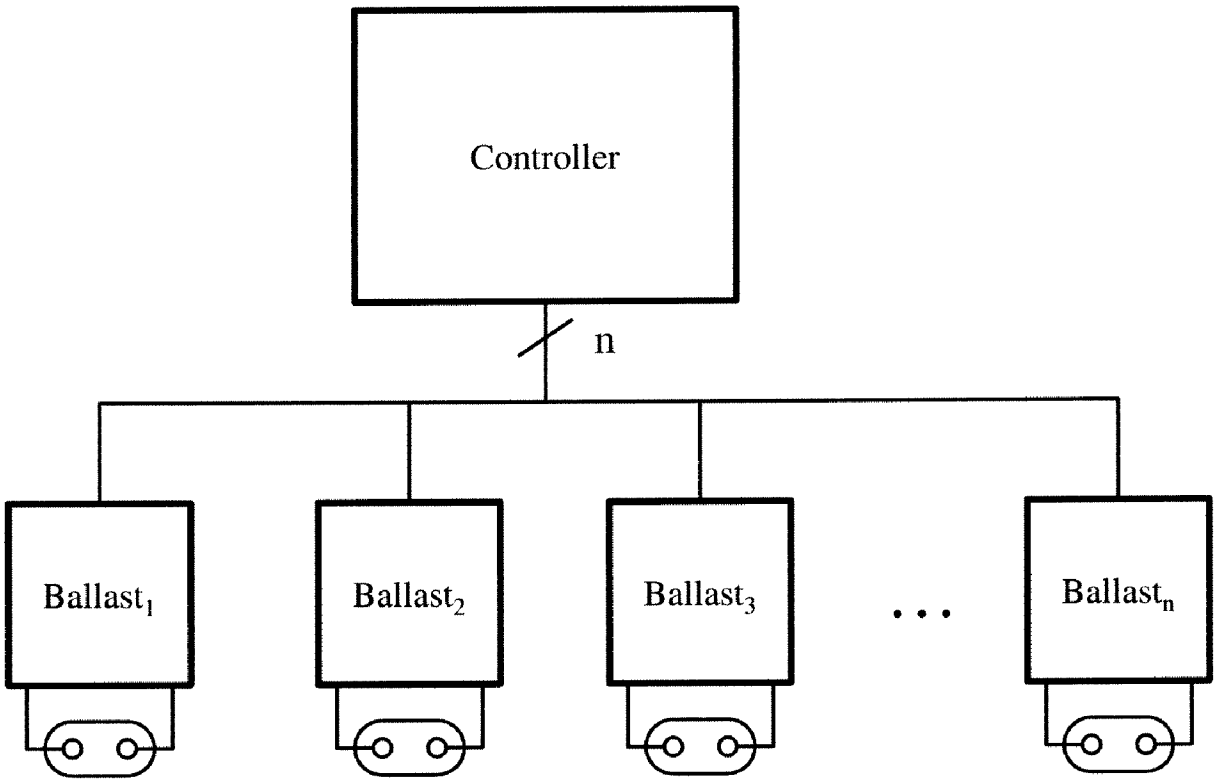
FIG. 1 (Prior Art)
FIG. 1 is a prior art depiction of a single controller backlight system.
Figure 2:
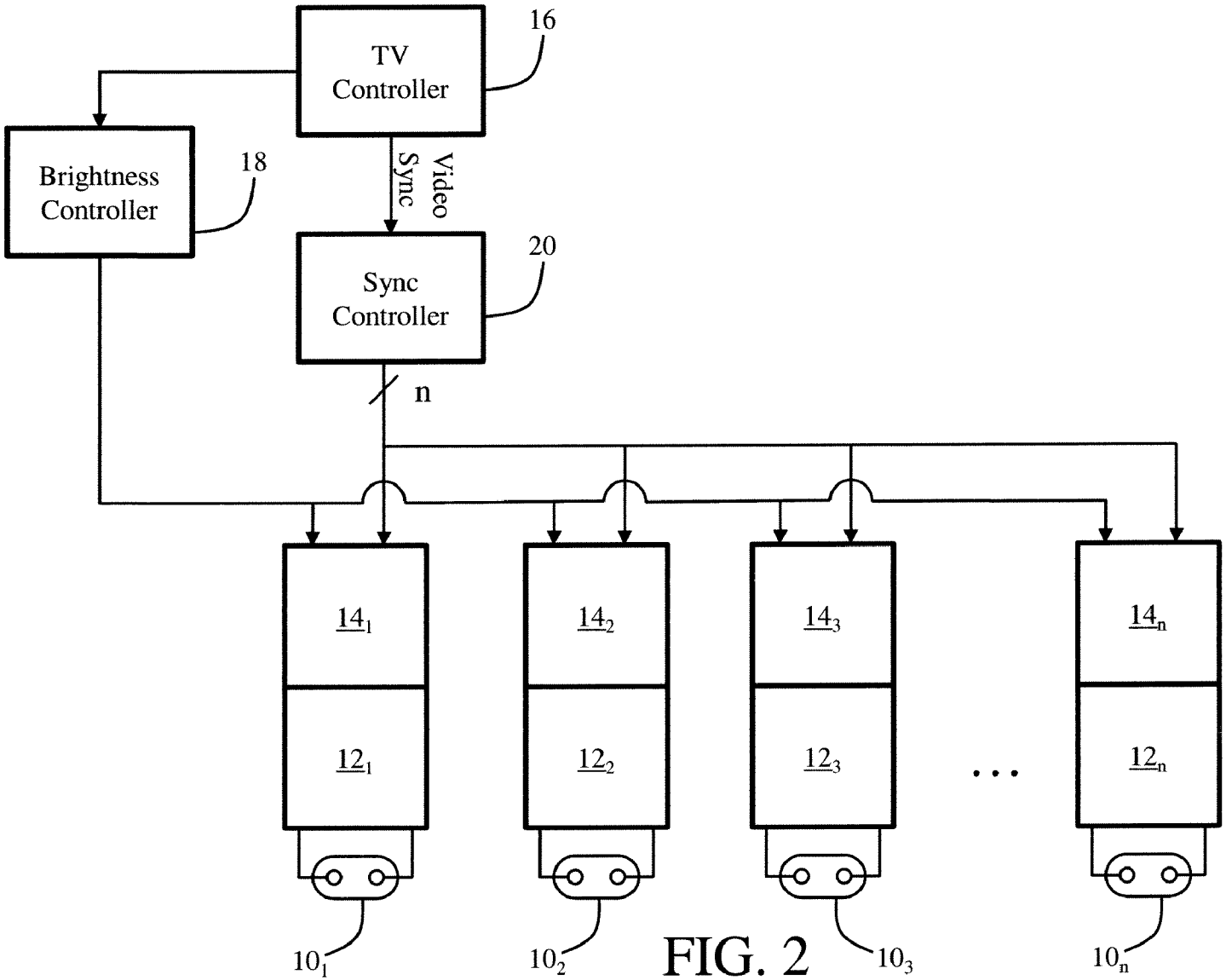
FIG. 2 shows a distributed synchronization signal embodiment of a backlight having multiple ballast controllers and a synchronization controller.

With reference now to FIG. 2, a distributed signal embodiment of a control circuit for an LCD backlight assembly is depicted. A number of backlights in the form of lamps $\mathbf{10}_1$, $\mathbf{10}_2$, $\mathbf{10}_3$, $\mathbf{10}_n$ are each controlled by a ballast circuit $\mathbf{12}_1$, $\mathbf{12}_2$, $\mathbf{12}_3$, $\mathbf{12}_n$. The lamps $\mathbf{10}_1$, $\mathbf{10}_2$, $\mathbf{10}_3$, $\mathbf{10}_n$ are preferably T5 hot cathode fluorescent lamps. In the embodiment of FIG. 2, each ballast $\mathbf{12}_1$, $\mathbf{12}_2$, $\mathbf{12}_3$, $\mathbf{12}_n$ has a ballast controller $\mathbf{14}_1$, $\mathbf{14}_2$, $\mathbf{14}_3$, $\mathbf{14}_n$ associated with it. The ballast controllers $\mathbf{14}_1$, $\mathbf{14}_2$, $\mathbf{14}_3$, $\mathbf{14}_n$ are responsible for directing the operation of their respective ballasts $\mathbf{12}_1$, $\mathbf{12}_2$, $\mathbf{12}_3$, $\mathbf{12}_n$. A TV controller 16 provides information for creating an image on the LCD. In accordance with that information, a brightness controller 18 directs the ballast controllers $\mathbf{14}_1$, $\mathbf{14}_2$, $\mathbf{14}_3$, $\mathbf{14}_n$ to illuminate their respective lamps $\mathbf{10}_1$, $\mathbf{10}_2$, $\mathbf{10}_3$, $\mathbf{10}_n$ to produce the backlighting for an image at the desired brightness. This analog voltage input is processed by each ballast controller into the desired PWM length (on time of each lamp) to achieve the desired brightness. The TV controller 16 also produces a video synchronization signal to a synchronization controller 20. Effectively, this signal represents the motion of the image over the display. The synchronization controller 20 relays the synchronization signal to the ballast controllers $\mathbf{14}_1$, $\mathbf{14}_2$, $\mathbf{14}_3$, $\mathbf{14}_n$, but delays it according to the motion appearing on the screen at the time.

This embodiment uses distributed ballast controllers $\mathbf{14}_1$, $\mathbf{14}_2$, $\mathbf{14}_3$, $\mathbf{14}_n$ to perform PWM dimming on lamps $\mathbf{10}_1$, $\mathbf{10}_2$, $\mathbf{10}_3$, $\mathbf{10}_n$ in which the PWM pulses are synchronized with the video signal. In this topology, the synchronization controller 20 is used to process the video synchronization from a television. The synchronization controller 20 then triggers pulses on its output pins corresponding to each lamp $\mathbf{10}_1$, $\mathbf{10}_2$, $\mathbf{10}_3$, $\mathbf{10}_n$. These pulses have a time offset from the video synchronization pulse dependent on the number of lamps $\mathbf{10}_1$, $\mathbf{10}_2$, $\mathbf{10}_3$, $\mathbf{10}_n$, the frequency of the video synchronization pulse, and an initial delay from the video synchronization pulse. These pulses are fed into the ballast controllers $\mathbf{14}_1$, $\mathbf{14}_2$, $\mathbf{14}_3$, $\mathbf{14}_n$ for each lamp $\mathbf{10}_1$, $\mathbf{10}_2$, $\mathbf{10}_3$, $\mathbf{10}_n$, which provide a variable width dimming pulse that is aligned to the output of the synchronization controller 20 to the respective lamp $\mathbf{10}_1$, $\mathbf{10}_2$, $\mathbf{10}_3$, $\mathbf{10}_n$.

Figure 3:
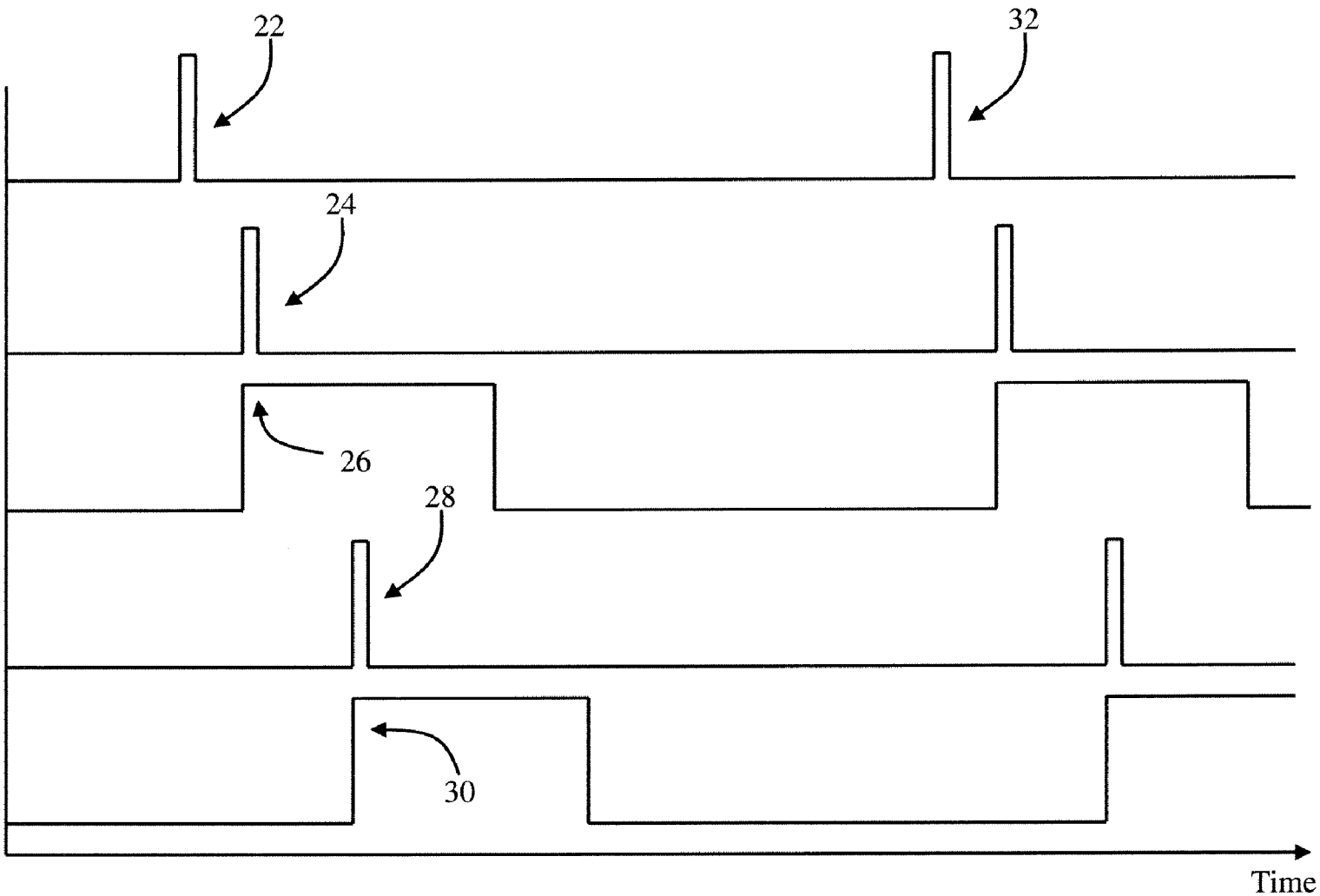
FIG. 3 depicts a time-delayed synchronization pulse.

FIG. 3 is a graphical depiction of the pulses delivered by the various controllers. The TV controller 16 delivers a video sync pulse 22. The synchronization controller 20 delays the video sync pulse 22. A delayed video sync pulse 24 is delivered to the first ballast controller $\mathbf{14}_1$. The first ballast controller $\mathbf{14}_1$ then issues a first lamp dimming pulse 26 that instructs the first ballast $\mathbf{12}_1$ to dim the first lamp $\mathbf{10}_1$. The synchronization controller 20 delays the video sync pulse 22 further, and delivers a second delayed video sync pulse 28 to the second ballast controller $\mathbf{14}_2$. The second ballast controller $\mathbf{14}_2$ issues a second lamp dimming pulse 30 that instructs the second ballast $\mathbf{12}_2$ to dim the second lamp $\mathbf{10}_2$. In this fashion, the synchronization controller 20 issues a delayed sync pulse to each ballast controller $\mathbf{14}_1$, $\mathbf{14}_2$, $\mathbf{14}_3$, $\mathbf{14}_n$. The video sync pulse 22 is delayed from one controller $\mathbf{14}_1$, $\mathbf{14}_2$, $\mathbf{14}_3$, $\mathbf{14}_n$ to the next according to the motion of the image scanning over the display area. The TV controller 16 then issues another synchronization pulse 32 that signifies the start of the next round of synchronization pulses. The end of the on period for each of the individual ballast controllers' $14_1$, $\mathbf{14}_2$, $\mathbf{14}_3$, $\mathbf{14}_n$ PWM signals is determined by each ballast controller based on the brightness control input.

Figure 4:
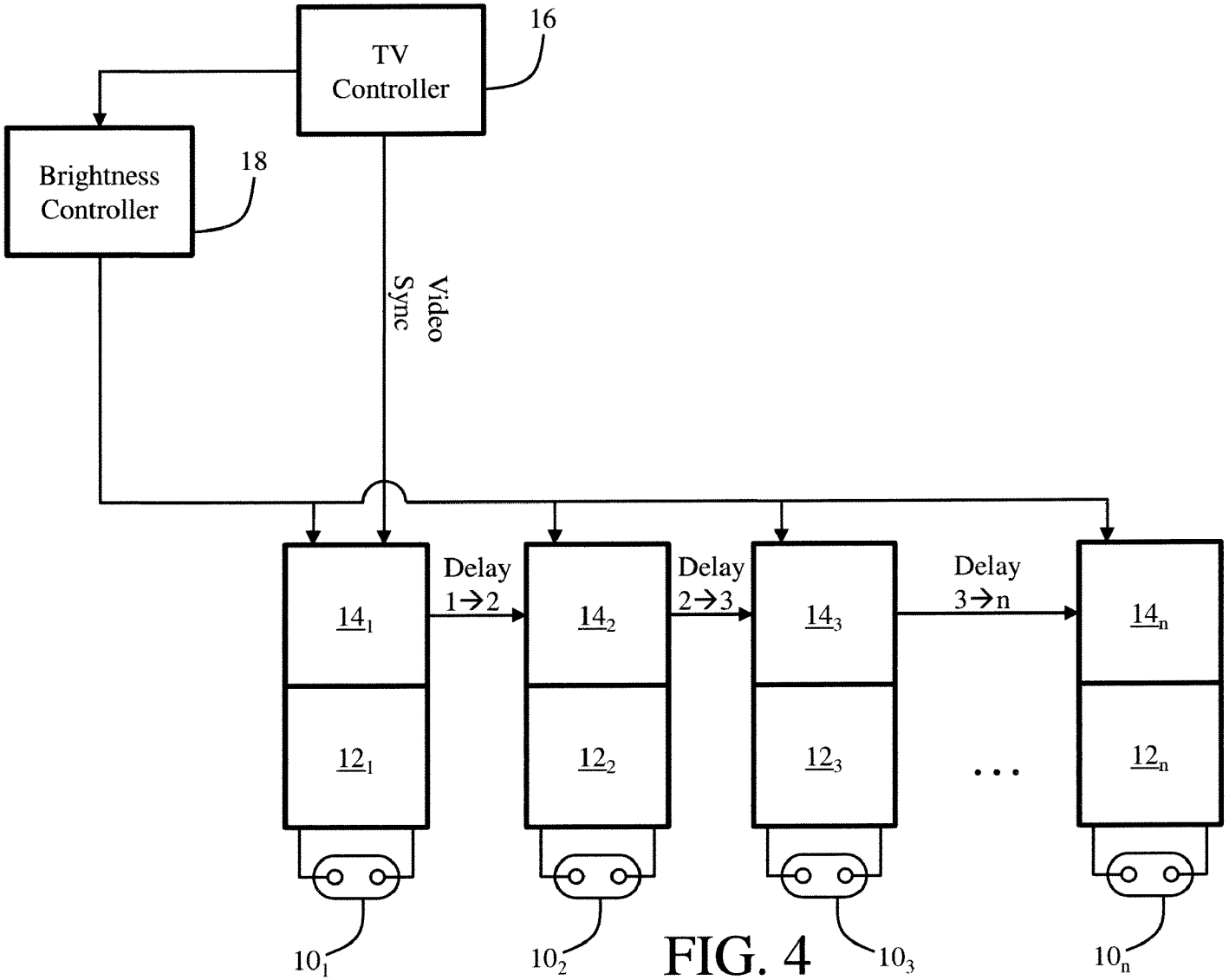
FIG. 4 shows a pass-through synchronization signal embodiment of a backlight scanning circuit.

With reference now to FIG. 4, another embodiment of the backlight control circuit is depicted. In this embodiment, the TV controller 16 feeds the video synchronization signal directly into the first ballast controller $\mathbf{14}_1$. The signal is then relayed by the first controller $\mathbf{14}_1$ to the second controller $\mathbf{14}_2$, and so on. Each relay signal is delayed just as with the embodiment of FIG. 2, but instead of the synchronization controller 20 doing the delaying, each individual ballast controller $\mathbf{14}_1$, $\mathbf{14}_2$, $\mathbf{14}_3$, $\mathbf{14}_n$ delays the pulse before it passes it on.

The TV controller 16 inputs a synchronization signal extracted from a video frame to the first ballast controller $\mathbf{14}_1$. The ballast controller $\mathbf{14}_1$ calculates a dimming pulse position of each lamp 10 that it controls. The dimming pulse position will correspond to the synchronization offset, equaling the total number of lamps in the backlight divided by the synchronization period, where each lamp's position is offset from the previous by the synchronization offset. When the ballast controller $\mathbf{14}_1$ outputs each dimming pulse for its lamp(s) $\mathbf{10}_1$, the ballast controller $\mathbf{14}_1$ then sends out a synchronization pulse corresponding to the next lamp $\mathbf{10}_2$ in the sequence. The next ballast controller $\mathbf{14}_2$ then uses this signal as its synchronization input, and it calculates the same pulse positions for its lamp(s) $\mathbf{10}_2$. The ballast controllers $\mathbf{14}_1$, $\mathbf{14}_2$, $14_3$, $14_n$ can be daisy-chained such that the output of one ballast controller $14_1$, $14_2$, $14_3$, $14_n$ can be fed into the next ballast controller $14_1$, $14_2$, $14_3$, $14_n$. Each ballast controller can also perform other functionality, such as end-of-life calculations, preheating, fault detection, and the like, for its lamps $10_1$, $10_2$, $10_3$, $10_n$.

It is preferable that there be a 1:1 ratio of ballast controllers $14_1$, $14_2$, $14_3$, $14_n$ to ballasts $12_1$, $12_2$, $12_3$, $12_n$. Thus, a relatively small integrated circuit can be used as the ballast controller $14_1$, $14_2$, $14_3$, $14_n$ for each ballast. Alternately, a single ballast controller $14_1$, $14_2$, $14_3$, $14_n$ can control multiple ballasts $12_1$, $12_2$, $12_3$, $12_n$. For example, in a twelve lamp system, a single ballast controller 14 could control three ballasts, 12 for a total of four ballast controllers 14.

By distributing the ballast control task among several different ballast controllers $14_1$, $14_2$, $14_3$, $14_n$, each ballast controller $14_1$, $14_2$, $14_3$, $14_n$ will have some functionality left over. In one embodiment, each ballast controller $14_1$, $14_2$, $14_3$, $14_n$ performs at least one other function, such as variable dimming, end-of-life, and preheating for its associated lamp(s) $10_1$, $10_2$, $10_3$, $10_n$.

A preferable chip for the ballast controller $14_1$, $14_2$, $14_3$, $14_n$ is the PIC12F615 microcontroller. Twelve chips run the equivalent of twelve dimmable lamp outputs. The system is capable of operating twelve lamps with a tightly bounded error. It also allows for distributed processing of lamps $10_1$, $10_2$, $10_3$, $10_n$, allowing for lamp scalability and added functionality per lamp $10_1$, $10_2$, $10_3$, $10_n$. This allows the system to be easily adapted to control a wide range of displays (i.e. more or fewer backlights) without having to do a major redesign of the software or microcontrollers.

This implementation has several effects. First, one ballast controller $14_1$, $14_2$, $14_3$, $14_n$ processes the video signal for its own lamp $10_1$, $10_2$, $10_3$, $10_n$. Also, the process does not require as many pins on the ballast controllers $14_1$, $14_2$, $14_3$, $14_n$, so extra pins are available to handle the actual dimming pulse calculations and other features. This implementation is power efficient compared to a single processor approach, and allows for added functionality to the ballast controller $14_1$, $14_2$, $14_3$, $14_n$. Additionally, circuit layout becomes simpler, as not as many electrical leads converge at a single point. The ability to use each ballast controller $14_1$, $14_2$, $14_3$, $14_n$ to perform additional functions obviates the need of adding separate processors for the additional functions.

This implementation preferably includes as many ballast controllers $14_1$, $14_2$, $14_3$, $14_n$ as there are lamps $10_1$, $10_2$, $10_3$, $10_n$ running at 4 MHz with 8 pins. The synchronization controller 20 preferably runs at 8 MHz with 18 pins. This replaces prior methods that utilize a single large processor running at 20 to 40 MHz, with at least 24 pins and upwards of 64 pins depending on the functionality required, functionality that can severely tax a single processor. A distributed microcontroller approach does not suffer from this restriction. The computational burden on any single microcontroller in a distributed approach does not increase as the number of lamps in the application increases. Therefore, the distributed strategy provides the developer with scalability not inherent to the single microcontroller approach, the size of the display, being limited only by the processors ability to time the inter-lamp delay required for synchronization. Power consumption is greatly reduced in this embodiment as opposed to a single large processor, because small processors have much simpler programs which can execute with high precision at clock speeds much less that would be required by a large processor. For example, the embodiment of FIG. 2 may draw 10 mA for the whole digital control, whereas a single larger chip may draw as much as 40 mA.

It is to be noted that each microcontroller in the distributed arrangement performs exactly the same function as any other. Each unit accepts a synchronizing signal and passes an identical synchronizing signal to the next processor in sequence, with an identical delay. Consequently, the microcontrollers are interchangeable, simplifying the serviceability of the display, the firmware development, and troubleshooting displays that may require service.

The present application contemplates a distributed approach to scanning, which distinguishes it over previous approaches which us a single processor for scanning. This provides a flexible solution that is not restricted to a maximum number of lamps, adds per-lamp functionality, reduces power consumption, and provides the ability to fold some elements into software. The invention has been described with reference to the preferred embodiments. Obviously, modifications and alterations will occur to others upon reading and understanding the preceding detailed description. It is intended that the invention be construed as including all such modifications and alterations.

What is claimed is:

1. A liquid crystal display comprising:

a display face;

a plurality of backlights for illuminating the display face, producing a visible light on the display face, each backlight being associated with a power supply for providing power to the backlight;

a plurality of liquid crystal elements that selectively obscure light from the plurality of backlights when activated by application of current;

a plurality of power supply controllers separate from the power supplies and individually operative to issue a synchronization pulse waveform with an on-time to individual ones of the power supplies according to a received brightness control input, the synchronization pulse waveform having an on-time during which the backlight is provided with power and an off-time during which the backlight is not provided with power, the individual power supply controllers continuously providing the synchronization pulse waveform to direct the corresponding power supplies to selectively dim the backlights during transition periods of the liquid crystal elements.

2. The liquid crystal display as set forth in claim 1, further including:

a synchronization controller for controlling the plurality of power supply controllers.

3. The liquid crystal display as set forth in claim 2, wherein the synchronization controller distributes a video synchronization signal to the power supply controllers that corresponds with motion of a scanning image.

4. The liquid crystal display as set forth in claim 3, wherein the distributed video synchronization signal is delayed to follow motion of an image over the display area.

5. The liquid crystal display as set forth in claim 1, further including:

a brightness controller that coordinates the backlights to display constituent portions of an image on the display.

6. The liquid crystal display as set forth in claim 1 wherein a first of the power supply controllers receives an original video synchronization signal instructing the first power supply controller to dim a first backlight, and the first power supply controller relays a delayed version of the video synchronization signal to a second of the power supply controllers.

7. The liquid crystal display as set forth in claim 6, wherein the delayed version of the video synchronization signal is delayed from the original video synchronization signal commensurate with a scanning speed of the image over the display area.

8. The liquid crystal display as set forth in claim 6, wherein the delayed version of the video synchronization signal is delayed in time by a synchronization offset multiplied by the number of backlights connected to a first power supply associated with the first power supply controller.

9. The liquid crystal display as set forth in claim 1, wherein each power supply controller of the plurality of power supply controllers contains firmware programmed into it that is identical to firmware programmed into each other power supply controller of the plurality of power supply controllers such that the power supply controllers are interchangeable.

10. The liquid crystal display as set forth in claim 1, wherein each controller of the plurality of power supply controllers performs at least one function other than directing power supplies to dim associated backlights.

11. The liquid crystal display as set forth in claim 1, wherein the power supplies are ballasts, the power supply controllers are ballast controllers, and the backlights are lamps.

12. The liquid crystal display as set forth in claim 1, wherein a first of the plurality of power supply controllers receives a video synchronization signal instructing the first power supply controller to stop providing power to a first backlight, and the first power supply controller outputs a video synchronization signal to a second of the plurality of power supply controllers that uses the video synchronization signal as the synchronization input.

13. The liquid crystal display as set forth in claim 12, wherein the video synchronization signal output by the first power supply controller is delayed in time by a synchronization offset multiplied by the number of backlights connected to a first power supply connected to the first power supply controller.

14. The liquid crystal display as set forth in claim 1, wherein the synchronization pulse is for one period.

15. A method of compensating for response times of liquid crystal elements in a liquid crystal display comprising:

backlighting a liquid crystal display screen with a plurality of backlights using corresponding power supplies;

selectively obscuring at least a portion of the backlighting by causing selected liquid crystal elements to become substantially opaque;

with a plurality of microcontrollers separate from the power supplies, selectively dimming the plurality of backlights during transition periods of the liquid crystal elements by individually issuing a synchronization pulse waveform with an on-time to individual ones of the power supplies according to a received brightness control input, the synchronization pulse waveform having an on-time during which the backlight is provided with power and an off-time during which the backlight is not provided with power, the individual microcontrollers continuously providing the synchronization pulse waveform to direct the corresponding power supplies to selectively dim the backlights during transition periods of the liquid crystal elements.

16. The method as set forth in claim 15, further including:

directing the plurality of microcontrollers with a synchronization controller.

17. The method as set forth in claim 16, further including:

supplying the plurality of microcontrollers with a synchronization pulse, delayed by the synchronization controller based on motion of an image across the liquid crystal display.

18. The method as set forth in claim 15, further including:

supplying a synchronization pulse to a first of the plurality of microcontrollers, the first microcontroller then passing the synchronization pulse on to microcontrollers downstream of the plurality of microcontrollers.

19. The method as set forth in claim 18, further including:

delaying the passing of the synchronization pulse from one microcontroller to the next commensurate with motion of an image over the display area.

20. The method as set forth in claim 15, wherein the plurality of microcontrollers is equal in number to the plurality of backlights.

21. The method as set forth in claim 15, further including:

performing at least one additional function with each microcontroller of the plurality of microcontrollers.

22. A scanning control circuit comprising:

a plurality of backlight power supplies, each power supply providing power to at least one backlight;

a plurality of power supply controllers separate from the backlight power supplies and individually operative to issue a synchronization pulse waveform with an on-time to individual ones of the backlight power supplies according to a received brightness control input, the synchronization pulse waveform having an on-time during which the backlight is provided with power and an off-time during which the backlight is not provided with power, the individual power supply controllers continuously providing the synchronization pulse waveform to direct the corresponding backlight power supplies when to provide power to their respective backlights;

a brightness controller for directing the power supply controllers to selectively illuminate their associated backlights;

a synchronization controller for directing the power supply controllers to dim their respective backlights based on response times of display obscuring elements.

23. The scanning control circuit as set forth in claim 22, wherein each power supply controller of the plurality of power supply controllers performs at least one function in addition to directing the backlight power supplies.

24. The scanning control circuit as set forth in claim 22, wherein the power supplies are ballasts, the power supply controllers are ballast controllers, and the backlights are lamps.

* * * * *